US005931036A

United States Patent [19]

Keller

[11] Patent Number: 5,931,036

[45] Date of Patent: Aug. 3, 1999

[54] ROTATING LOCKING CYLINDER FOR A SAFETY LOCK

[76] Inventor: Ernst Keller, Untere Schwandenstrasse 22, CH-8805 Richterswil, Switzerland

[21] Appl. No.: 08/913,464

[22] PCT Filed: Mar. 8, 1996

[86] PCT No.: PCT/CH96/00089

§ 371 Date: Sep. 18, 1997

§ 102(e) Date: Sep. 18, 1997

[87] PCT Pub. No.: WO96/29492

PCT Pub. Date: Sep. 26, 1996

[30] Foreign Application Priority Data

Mar. 20, 1995 [CH] Switzerland ..... 786/95

[51] Int. Cl.[6] ..... E05D 27/00

[52] U.S. Cl. ..... 70/495; 70/493

[58] Field of Search ..... 70/495, 496, 493

[56] References Cited

U.S. PATENT DOCUMENTS

| | | | |
|---|---|---|---|
| 3,455,130 | 7/1969 | Basseches | 70/495 X |
| 3,494,158 | 2/1970 | Bauer et al. . | |
| 4,085,601 | 4/1978 | Sauder | 70/495 |
| 4,222,252 | 9/1980 | Tietz . | |
| 4,377,940 | 3/1983 | Hucknall . | |
| 4,434,636 | 3/1984 | Prunbauer | 70/495 X |
| 4,712,399 | 12/1987 | Mattossovich | 70/495 |
| 5,375,444 | 12/1994 | Smith | 70/493 X |
| 5,475,998 | 12/1995 | Raskevicius et al. | 70/493 X |
| 5,517,840 | 5/1996 | Haggstrom | 70/495 |
| 5,640,865 | 6/1997 | Widen | 70/495 |

FOREIGN PATENT DOCUMENTS 40 35 934 6/1991 Germany .

*Primary Examiner*—Suzanne Dino Barrett
*Attorney, Agent, or Firm*—Browdy and Neimark

[57] ABSTRACT

The rotary locking cylinder described has a stationary part (2) and a rotating part (3) plus several tumblers (8) each with a core pin (10) and a housing pin (9). Mounted in the rotating part (3) is at least one locking element (22) which can be displaced approximately at right angles to the core pin (10) of a tumbler (8) and in its position of rest engages in a recess (20) in the stationary part (2). The recess (20) in the stationary part (2) has a control surface (19) designed so that, when the unlocked stationary part (2) is rotated, the locking element (22) is moved towards the core pin (10). Machined in the surface (10*b*) of the core pin (10) is a groove (12) such that, with the core pin (10) inserted, after the rotating part (3) has rotated through a relatively small angle, the locking element (22) can be pushed far enough into the groove (12) for it to be lifted out of the recess (20) in the stationary part (2) and, with the core pin (10) not inserted, the locking element (22) essentially cannot be pushed out of its position of rest and rests against the surface (10*b*) of the core pin (10).

8 Claims, 2 Drawing Sheets

ROTATING LOCKING CYLINDER FOR A SAFETY LOCK

BACKGROUND OF THE INVENTION

1. Technical Field of the Invention

The invention relates to a rotating closing cylinder for a safety lock, having a stator and a rotor and a plurality of tumblers that respectively have a core pin and a housing pin.

2. Prior Art

Rotating closing cylinders of this type are well-known. To enable the rotor to rotate, the tumblers are aligned with a key that is inserted into the key conduit. The security of these rotating closing cylinders can be impeded by the following break-in method: A break-in tool is used to rotate the rotor about its axis of rotation with a certain torque and, at the same time, the tumblers are moved radially outwardly due to vibration until all of the housing pins are behind the shoulder of the rotor that has been formed by the rotation, and the rotor can be rotated further, even without a key. Thwarting this break-in method was heretofore very costly.

OBJECT OF THE INVENTION

It is the object of the invention to improve the break-in protection provided by a generic rotating closing cylinder. Nevertheless, the rotating closing cylinder is intended to be inexpensive to produce, and function reliably. Break-in protection is defined here as the degree of difficulty an intruder would face in attempting to align the tumblers without knowledge of the lock code, but without destroying the lock. The invention is particularly intended to improve the break-in protection provided against the above-described break-in method.

In a generic rotating closing cylinder, the object is accomplished in that at least one blocking element is seated in the rotor to be displaceable approximately transversely to a core pin of a tumbler, and to extend into a recess of the stator when in the non-operative position; that the recess of the stator has a control surface such that the blocking element is moved toward the core pin when the unblocked rotor is rotated; that a recess is cut into the circumference of the core pin such that, when the core pin is aligned after the rotor has been rotated by a comparatively small angle, the blocking element can be pushed into the recess of the stator until a it has been raised out of the recess; and that, when the core pin is not aligned, the blocking element basically cannot be displaced out of its non-operative position, and rests against the outside of the core pin.

SUMMARY OF THE INVENTION

In the rotating closing cylinder of the invention, the rotor can only be rotated if both the housing pins and the core pins are aligned. If one core pin is not aligned, the blocking element cooperating with it cannot be displaced out of the non-operative position into the unblocked position. If all of the core pins are aligned, the recesses of the core pins are aligned such that the blocking elements can be displaced and can extend into these recesses. An essential point is that the blocking elements extend into the recesses of the core pins only when the rotor has been rotated out by the comparatively angle that is typical for rotating.

Thus, the blocking elements cannot be used to align the core pins in the above-described break-in method. Only the housing pins can be aligned for use in the method, not the core pins. The core pins are permanently unaligned in the corresponding bores of the rotor; it is highly improbable that all of the core pins will happen to be simultaneously positioned such that all of the blocking elements could be displaced. A significant advantage of the invention is that the necessary changes to existing rotating closing cylinders are comparatively minor. Considerably higher security with respect to the described break-in method can be achieved at a relatively low cost.

According to a modification of the invention, production is particularly inexpensive if the blocking element is embodied as a pin seated in a bore of the rotor. A plurality of such blocking elements is preferably provided. Each blocking element is then associated with a core pin of a tumbler series. The blocking element can, however, be a slide that cooperates with a plurality of tumblers. The blocking element or elements can be kept in the non-operative position by its or their natural weight, or by a spring force.

BRIEF DESCRIPTION OF THE DRAWINGS

Further, advantageous features ensue from the dependent claims, the following description and the drawings.

Two embodiments of the invention are explained in detail below in conjunction with the drawings.

DETAILED DESCRIPTION OF THE PREFERRED EMBODIMENTS OF THE INVENTION

Figure 1:
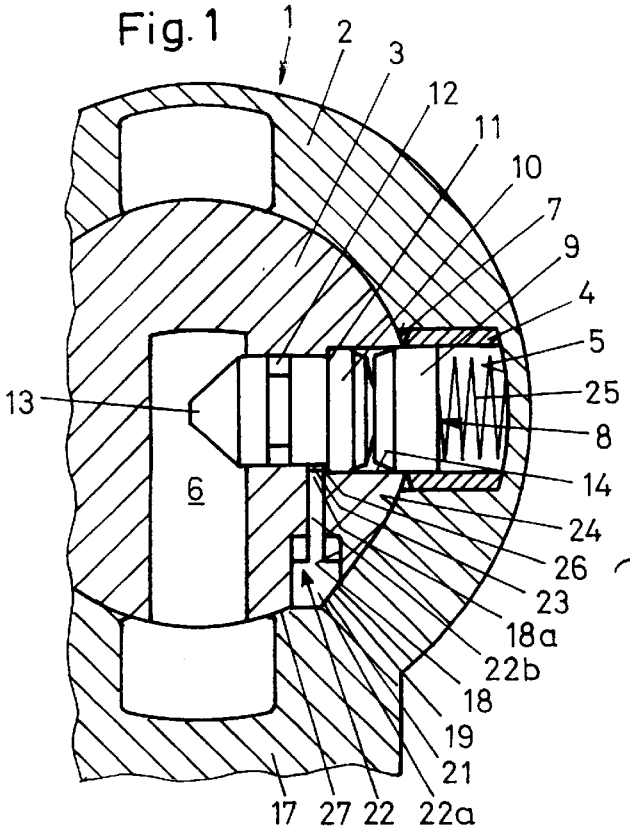
FIG. 1 shows a section through a part of a rotating closing cylinder of the invention.
Figure 2:
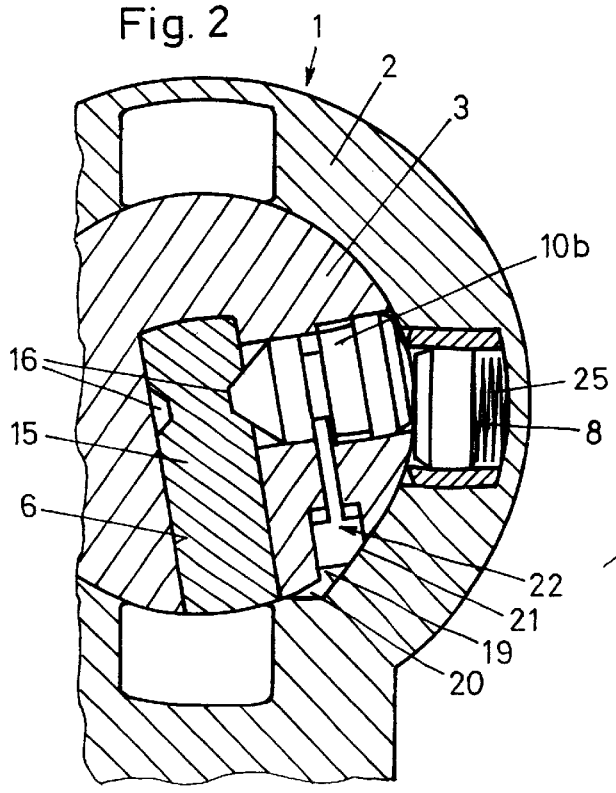
FIG. 2 shows a section according to FIG. 1, but with an inserted key and the rotor being in the rotated, unlocked state, FIGS. 3 and 4 schematic representations of the cooperation between the blocking element and the core pin.

FIGS. 1 and 2 show a rotating closing cylinder 1 which includes a stator 2 having a cylinder pocket 17, only indicated here, in which a rotor 3 is seated in a longitudinal bore 24. Pin tumblers 8, each having a housing pin 9 and a core pin 10, are seated in longitudinal conduits 5 of the stator 2 and in radial, stepped bores 14 of the rotor 3. A slide 4 is inserted into each conduit 5, and receives the housing pins 9 of a tumbler series; seated in the slide are springs 25, which hold the tumbler pins 9 and 10 in the position shown in FIG. 1, in which the core pins 10 respectively rest with a shoulder 11 against a shoulder 26 of a stepped bore 14. In this position, the rotor is blocked, as shown, by the housing pins 9 extending past the shear line 7.

If a flat key 15 is inserted into the key conduit 6, the tumblers 8 can be aligned in a manner known per se, and the rotor 3 can be rotated. In this instance, the key 15 is preferably a flat key having control bores 16. The core pins 10 vary in length; the control bores 16 correspondingly differ in depth.

A stepped bore 18, which terminates at the top into the stepped bore 14, is cut into the rotor 3, transversely to each stepped bore 14. The stepped bore 14 could also be cut into the rotor 3 from above, and held in the nonoperative position by means of a compression spring. At the bottom, the stepped bore 18 is open opposite a recess 20 of the stator. A blocking element 22 having a head **22*a* and an upwardly-projecting pin 22*b* is inserted from below into each stepped bore 18. The head 22*a* extends into the recess 20 and rests with a surface 21, which extends at a diagonal with respect to the shear 7 against a parallel control surface 19 of the recess 20 (FIG. 2**).

The blocking elements 22 are held by their own weight in the rotor position shown in FIG. 1. An embodiment is also conceivable, however, in which the blocking elements 22 are held in the non-operative position by compression springs, not shown here. Compression springs are useful when the blocking elements 22 are inserted from above into corresponding bores of the rotor.

Each core pin 10 has a circumferential groove 12 that is cut into the outside and is disposed and embodied such that it is positioned at the height of the associated stepped bore 18 when the core pin is aligned. The width of the groove 12 corresponds approximately to the width of the upper termination 18*a* of the stepped bore 18.

The function of the rotating closing cylinder 1 of the invention is described below.

In the non-operative position of the rotor 3 according to FIG. 1, the rotor is blocked against rotation by the housing pins 9. If all of the tumblers 8 are aligned with an associated key 15, when the rotor 3 is rotated, the blocking elements 22 are lifted out of the recesses 20 by the control surfaces 19 at the surfaces 21, and the pins 22*b* extend into the correspondingly-positioned groove 12. If, however, at least one core pin 10 is not aligned, the associated blocking element 22 cannot be lifted from the recess 20 because the pin 22*b* rests with its end face against the outside 10*b*, behind the groove 12. In the above-described break-in method, in which only the housing pins 9 can be aligned, it is highly likely that, at all times, a few core pins will not be in aligned positions, so the blocking elements 22 block the rotor 3 when an attempt is made to rotate it.

The blocking elements 22 are seated with some play in the stepped bores 18. When the rotor 3 is rotated in accordance with the aforementioned break-in method, the blocking elements 22 do not engage the core pins 10, and accordingly cannot be aligned with the aid of the blocking elements 22.

Figure 3:
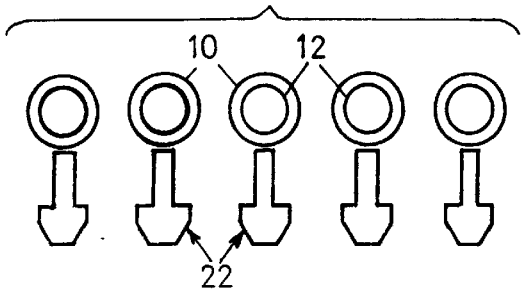
Figure 4:
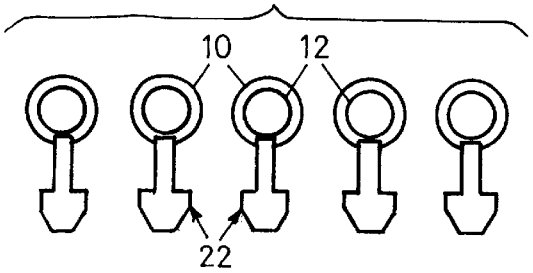

As shown in FIGS. 3 and 4, a blocking element 22 is associated with each tumbler of a tumbler series. FIG. 3 shows the position of the tumbler elements when the rotor 3 is in the position shown in FIG. 1. In contrast, FIG. 4 shows the blocking elements 22 in the position of the rotor 3 shown in FIG. 2. As is apparent from the drawing, the blocking elements are lifted and respectively extend into a groove 12. Another conceivable embodiment is one in which the number of blocking elements 22 is less than the number of tumblers 8. Finally, it is also conceivable for a few or all of the blocking elements 22 to be connected to one another.

Figure 6:
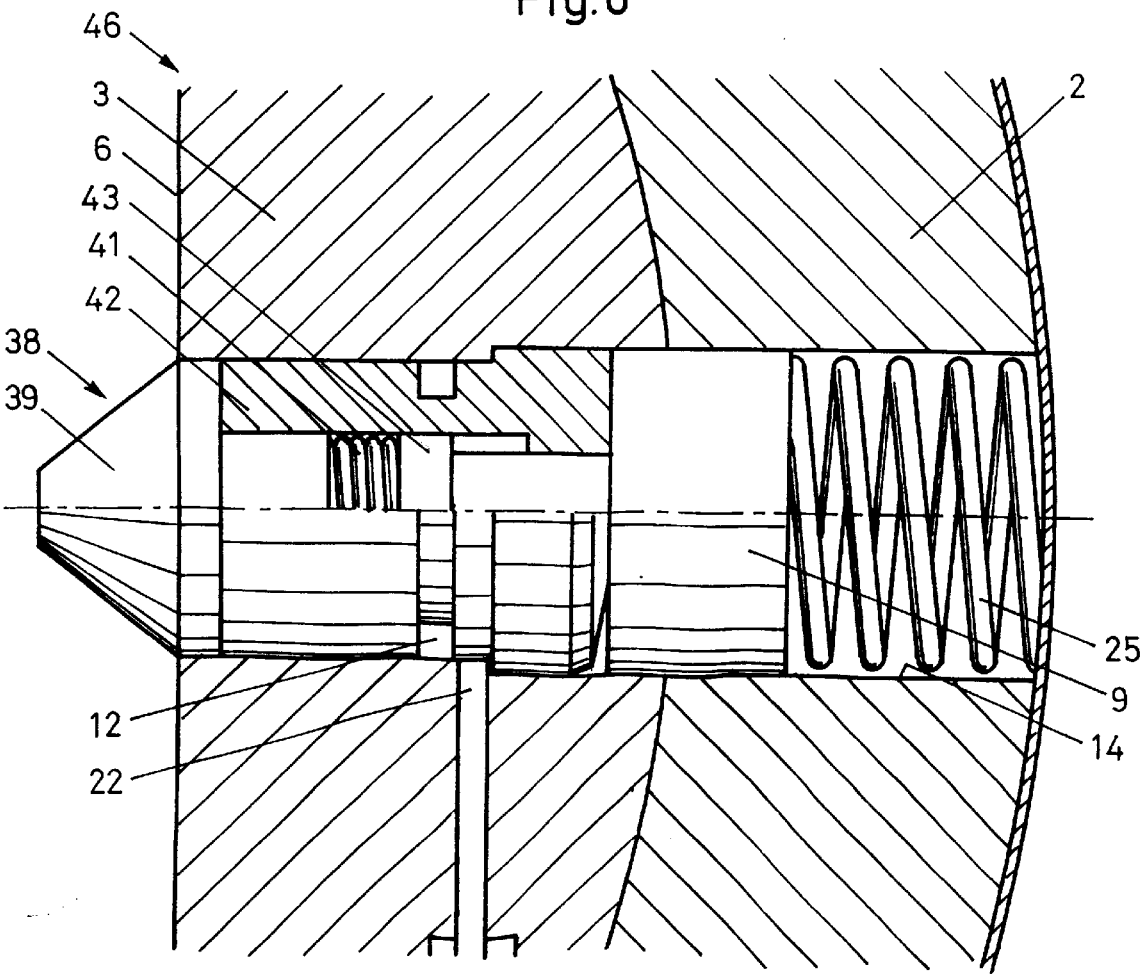
FIG. 6 shows a section through a part of a rotating closing cylinder of the invention, according to the modification.

The rotating closing cylinder 46 shown in FIG. 6 differs from the above-described cylinder 1 solely through the embodiment of at least one tumbler 38. This tumbler 38 has a conventional housing pin 9 and a core pin 45, which are to be aligned for enabling the rotor 3. The core pin 45 comprises a tip 39 having a cylindrical neck 40, onto which a hollow-cylindrical part 42 is inserted. A pin 44 having a flange 43 is seated to be displaceable to a limited extent in the inserted part. A compression spring 41, which is inserted into the part 42 and is weaker than the compression spring 25, exerts a force onto the pin 44 that acts in the left direction in FIG. 6.

Figure 5:
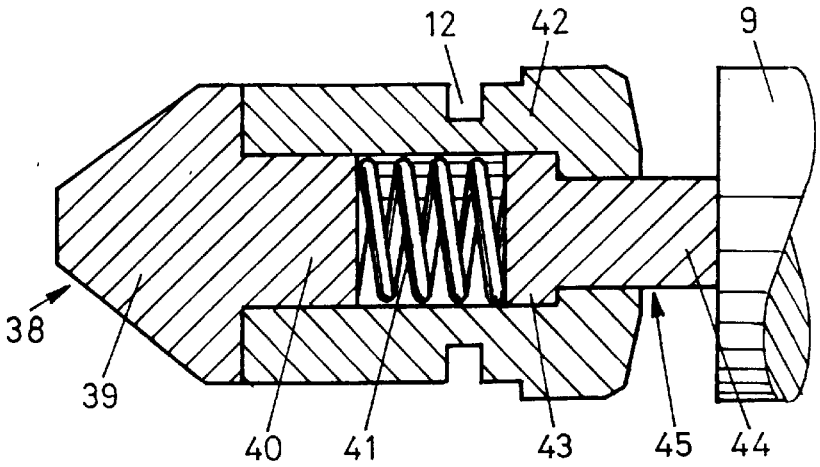
FIG. 5 shows a section through a tumbler according to a modification of the invention.

In conventional use of the rotating closing cylinder, the pin 45 remains in the lowered position shown in FIG. 6, and has no effect on the function of the rotating closing cylinder. If, however, in an unauthorized opening attempt, the housing pin 9 is moved outwardly without the core pin 38, the pin 44 is immediately moved radially outwardly by the spring 41, and follows the housing pin 9, as indicated in FIG. 5. The core pin 38 is consequently held in the position shown in FIG. 6 due to the corresponding counterforce. During an attempt to bring the core pin 38 into the position in which the groove 12 is positioned at the height of the blocking element 22, the spring 41 counteracts this action, thereby impeding the attempted positioning of the core pin 38.

As explained above, the rotor 3 cannot be rotated due to the blocking elements 22 until the corresponding core pins 45 for all of the blocking elements 22 are positioned such that the respective groove 12 is at the height of the associated blocking element 22. The corresponding alignment is especially impeded if a plurality of tumblers 38 cooperate with blocking elements 22 and are provided with pins 44.

I claim:

1. Rotating closing cylinder for a safety lock, having a stator (2) and a rotor (3) and a plurality of tumblers (8) respectively having a core pin (10) engageable with a housing pin (9) located respectively in a slide (4) in the stator (2) and a steeped bore (14) in the rotor (3), wherein at least one displaceable blocking element (22) is seated in the rotor (3) and, in a non-operative position where the core pin 10 and the housing pin (9) are coaxially engaged, the blocking element (22) extends into a recess (20) of the stator (2), that the recess (20) of the stator (2) has a control surface (19) such that, when the unblocked rotor (3) is rotated, the blocking element (22) is moved toward the core pin (10), that a recess (12) is cut into the circumference (10*b*) of the core pin (10) such that, when the core pin (10) is aligned with a shear line (7) following a rotation of the rotor (3) by a comparatively small angle, the blocking element (22) can be pushed into the recess (12) of the stator (2) until the blocking element (22) has been lifted out of the recess (12), and that, when the core pin (10) is not aligned the blocking element (22) basically cannot be displaced out of said non-operative position and rests against the outside (10*b*) of the core pin (10), wherein the blocking element (22) is seated with some play in the rotor (3) such that, when the rotor (3) is rotated, the blocking element (22) is not in engagement with the associated core pin (10), and that the blocking element (22) is displaceable approximately transversely to the core pin (10) of tumbler (8) and each of said plurality of tumblers (8) is engaged by a spring (25) which holds the housing pin (9) in a position in which a first shoulder (11) of the corresponding core pin (10) engages a second shoulder (26) of the stepped bore (14) of the rotor, wherein the housing pin (9) extends past the shear line (7) of said stepped bore (14) of the rotor.

2. Rotating closing cylinder according to claim 1, wherein the recess is a circumferential groove at the circumference (10*b*) of the core pin (10).

3. Rotating closing cylinder according to claim 1 or 2, wherein the blocking element (22) is inserted into a recess (18) that is cut into the underside or top side of the rotor (3).

4. Rotating closing cylinder according to claim 1, characterized in that the blocking element (22) has a pin that is seated in a bore (18) of the rotor (3).

5. Rotating closing cylinder according to one of claims 1 through 4, wherein a blocking element (22) is respectively associated with a plurality of tumblers (8).

6. Rotating closing cylinder according to claim 1, wherein the blocking element (22) or elements has or have a head (22*a*) that extends into a recess (20) of the stator (2).

7. Rotating closing cylinder according to claim 6, wherein weight of the head (22*a*) holds the blocking element in the non-operative position in the recess (20).

8. Rotating closing cylinder for a safety lock, having a stator (2) and a rotor (3) and a plurality of tumblers (8) respectively having a core pin (10) engageable with a housing pin (9) located respectively in a slide (4) in the stator (2) and a stepped bore (14) in the rotor, wherein at least one displaceable blocking element (22) is seated in the rotor (3) and, in a non-operative position where the core pin (10) and the housing pin (9) are coaxially engaged, the blocking element (22) extends into a recess (20) of the stator (2), that the recess (20) of the stator (2) has a control surface (19) such that, when the unblocked rotor (3) is rotated, the blocking element (22) is moved toward the core pin (10), that a recess (12) is cut into the circumference (10*b*) of the core pin (10) such that, when the core pin (10) is aligned with a shear line (7) following a rotation of the rotor (3) by a comparatively small angle, the blocking element (22) can be pushed into the recess (12) of the stator (2) until the blocking element (22) has been lifted out of the recess (12), and that, when the core pin (10) is not aligned, the blocking element (22) basically cannot be displaced out of said non-operative position and rests against the outside (10*b*) of the core pin (10) wherein the blocking element (22) is seated with some play in the rotor (3) such that, when the rotor (3) is rotated, the blocking element (22) is not in engagement with the associated core pin (10), and that the blocking element (22) is displaceable approximately transversely to a core pin (10) of a tumbler (8), wherein at least one core pin (38) has a pin (44) that is seated to be displaceable to a limited extent in the core pin and, due to the action of a spring (41), follows a housing pin (9) moving away from the core pin (38).

* * * * *